US012781366B2

(12) United States Patent
Kawano

(10) Patent No.: US 12,781,366 B2
(45) Date of Patent: Nov. 3, 2026

(54) ELECTROCHEMICAL SYSTEM

(71) Applicant: HONDA MOTOR CO., LTD., Tokyo (JP)

(72) Inventor: Takumi Kawano, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 510 days.

(21) Appl. No.: 18/530,493

(22) Filed: Dec. 6, 2023

(65) Prior Publication Data

US 2024/0191376 A1 Jun. 13, 2024

(30) Foreign Application Priority Data

Dec. 12, 2022 (JP) ..... 2022-197749

(51) Int. Cl.

| | |
|---|---|
| ***C25B 15/08*** | (2006.01) |
| ***C25B 1/04*** | (2021.01) |
| ***C25B 9/05*** | (2021.01) |
| ***C25B 15/025*** | (2021.01) |

(52) U.S. Cl.

CPC ..... *C25B 15/025* (2021.01); *C25B 1/04* (2013.01); *C25B 9/05* (2021.01); *C25B 15/083* (2021.01)

(58) Field of Classification Search

None

See application file for complete search history.

(56) References Cited

U.S. PATENT DOCUMENTS

| | | | | |
|---|---|---|---|---|
| 2012/0209434 | A1* | 8/2012 | Kurashina | C25B 1/04 700/273 |
| 2014/0102911 | A1* | 4/2014 | Kurashina | C25B 1/04 204/278 |
| 2020/0332426 | A1* | 10/2020 | Kurashina | C25B 1/04 |
| 2022/0042192 | A1 | 2/2022 | Mitsuta | |
| 2022/0166041 | A1 | 5/2022 | Mitsuta | |

FOREIGN PATENT DOCUMENTS

| | | | |
|---|---|---|---|
| JP | 2022-029892 | A | 2/2022 |
| JP | 2022-083098 | A | 6/2022 |

* cited by examiner

*Primary Examiner* — Luan V Van

(74) *Attorney, Agent, or Firm* — Carrier, Shende & Associates P.C.; Joseph P. Carrier; Fulchand P. Shende

(57) ABSTRACT

An electrochemical system includes a first stack, a first tank for storing high-pressure gas output from the first stack, a check valve disposed in a flow path connecting the first stack and the first tank, a first pressure sensor and a second pressure sensor connected respectively to the upstream and the downstream of the check valve, and a control unit. The control unit determines that an electrolyte membrane has been damaged when the pressure difference between the upstream and the downstream of the check valve exceeds a predetermined pressure.

10 Claims, 5 Drawing Sheets

ELECTROCHEMICAL SYSTEM

CROSS-REFERENCE TO RELATED APPLICATIONS

This application is based upon and claims the benefit of priority from Japanese Patent Application No. 2022-197749 filed on Dec. 12, 2022, the contents of which are incorporated herein by reference.

BACKGROUND OF THE INVENTION

Field of the Invention

The present invention relates to an electrochemical system for generating a gas by an electrochemical reaction.

Description of the Related Art

Various electrochemical systems have been proposed in which a stack having an electrolyte membrane is used to electrochemically generate a gas or to electrochemically boost the pressure of a gas. For example, JP 2022-029892 A discloses an electrochemical system that decomposes water supplied as raw material, in a water electrolysis stack, to generate oxygen and hydrogen and stores the oxygen and the hydrogen as compressed gas in oxygen and hydrogen gas tanks.

SUMMARY OF THE INVENTION

In the electrochemical system as described above, the stack may be used under a condition in which a large differential pressure is generated between the anode side and the cathode side of the electrolyte membrane. If the electrolyte membrane is damaged in such a stack, gas on the high-pressure side leaks to the low-pressure side, which may cause trouble in other devices.

An object of the present invention is to solve the aforementioned problem.

According to an aspect of the present invention, there is provided an electrochemical system including: a first stack including a membrane electrode assembly containing: an electrolyte membrane; and a first electrode and a second electrode sandwiching the membrane electrode assembly therebetween; a first tank configured to store a first gas having a high-pressure, output from the first stack; a check valve disposed in a flow path that connects the first stack and the first tank; a first pressure sensor connected to the flow path at an upstream of the check valve; a second pressure sensor connected to the flow path at a downstream of the check valve; and a control unit configured to determine whether the electrolyte membrane has been damaged or not, based on a pressure detected by the first pressure sensor and a pressure detected by the second pressure sensor, wherein the control unit determines that the electrolyte membrane has been damaged when a differential pressure obtained by subtracting the pressure detected by the first pressure sensor from the pressure detected by the second pressure sensor exceeds a predetermined pressure.

The electrochemical system of the above aspect can protect the other devices connected to the first stack by detecting leakage of the first gas due to damage to the electrolyte membrane.

The above and other objects, features, and advantages of the present invention will become more apparent from the following description when taken in conjunction with the accompanying drawings, in which a preferred embodiment of the present invention is shown by way of illustrative example.

DETAILED DESCRIPTION OF THE INVENTION

First Embodiment

Figure 1:
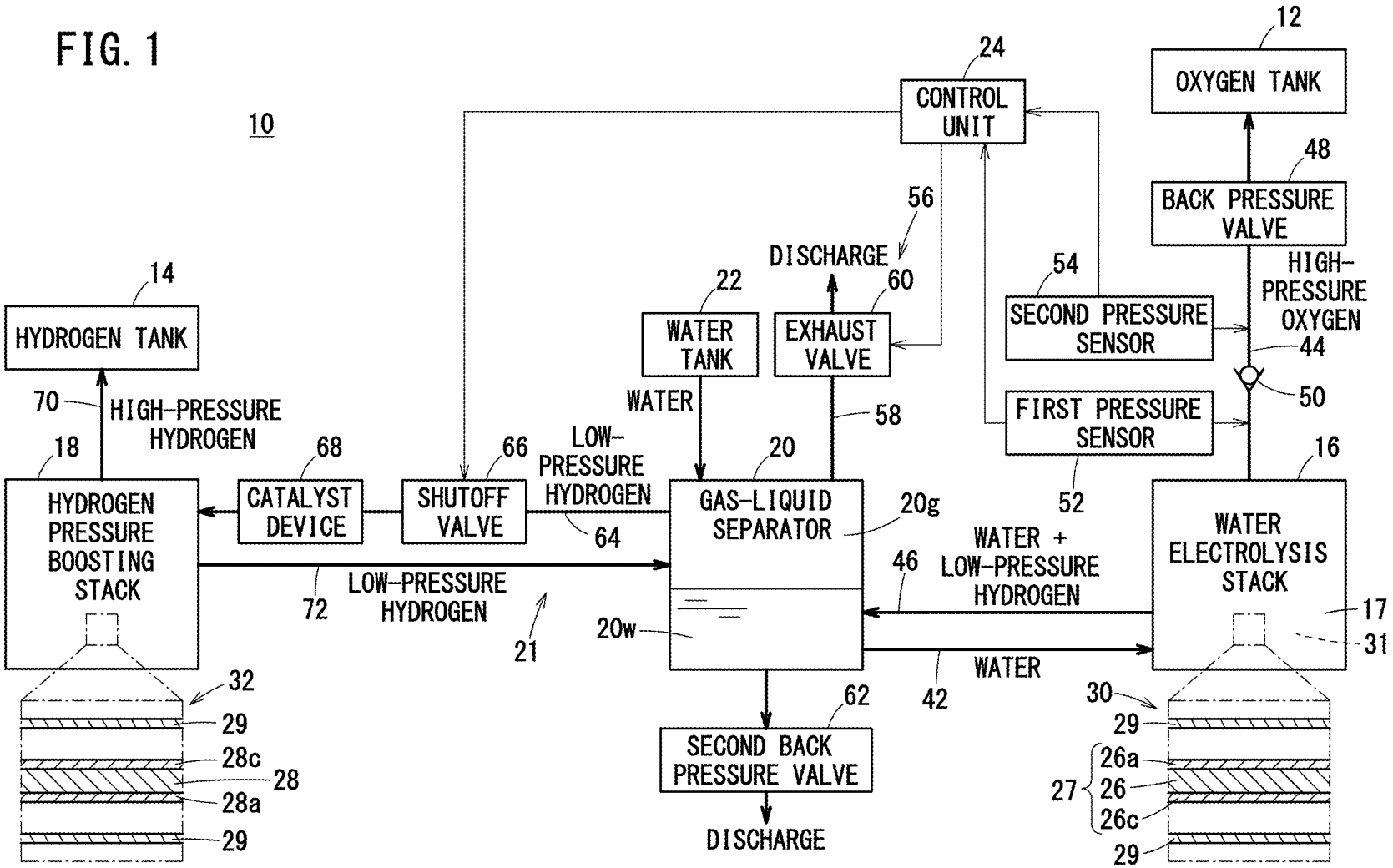
FIG. 1 is a diagram showing a configuration of an electrochemical system according to a first embodiment.

The electrochemical system 10 of the present embodiment is a water electrolysis system that electrolyzes water by power supply from the outside. The electrochemical system 10 generates a first gas (oxygen gas in the present embodiment) and a second gas (hydrogen gas in the present embodiment). The electrochemical system 10 has a function of electrochemically boosting the pressure of gas, and stores the first gas in a compressed state in a first tank 12 (an oxygen tank) and stores the second gas in a compressed state in a second tank 14 (a hydrogen tank). The electrochemical system 10 is used, for example, in an energy storage system for storing excess electrical energy in the form of oxygen and hydrogen. The configuration of the electrochemical system 10 will be described below.

The electrochemical system 10 mainly includes a first stack 16, a hydrogen pressure boosting stack 18, a gas-liquid separator 20, the first tank 12, the second tank 14, a water tank 22, and a control unit (a processing circuitry) 24. The control unit 24 is configured as a computer including a CPU and a memory, for example. Moreover, it should be noted that at least a portion of the control unit 24 may be implemented by an integrated circuit such as an ASIC (Application Specific Integrated Circuit) or a FPGA (Field-Programmable Gate Array). Further, at least a portion of the control unit 24 may be constituted by an analog electronic circuit including a discrete device such as an operational amplifier, a comparator, etc.

The first stack 16 of the present embodiment is a water electrolysis stack 17. The water electrolysis stack 17 includes a membrane electrode assembly 27. The membrane electrode assembly includes an electrolyte membrane 26, and a first electrode (anode) 26*a* and a second electrode (cathode) 26*c* sandwiching the electrolyte membrane therebetween. The electrolyte membrane 26 is, for example, an anion exchange membrane that transports hydroxide ions $OH^-$. The membrane electrode assembly 27 is sandwiched between separators 29 to form a unit cell 30. The first stack 16 has a cell stack 31 which contains several tens to several hundreds of unit cells 30 stacked together in a stacking direction. The cell stack 31 is driven by electric current supplied from the anode 26*a* and the cathode 26*c* in the stacking direction.

Each unit cell 30 generates oxygen gas from the anode 26*a* and hydrogen gas from the cathode 26*c*. The cathode

26*c* is supplied with water through a supply flow path 42. The cathode 26*c* decomposes a part of the water into hydrogen ions $H^+$ and hydroxide ions $OH^-$ by an electrochemical reaction. The hydrogen ions $H^+$ receive electrons at the surface of the cathode 26*c* to become hydrogen gas. The hydrogen gas generated in the cathode 26*c* is discharged from the first stack 16 through a second flow path 46 together with water. The hydrogen gas and the water flow into the gas-liquid separator 20 through the second flow path 46.

The hydroxide ions $OH^-$ are transported to the anode 26*a* by the electrolyte membrane 26. The hydroxide ions $OH^-$ release electrons at the surface of the anode 26*a*, and as a result, oxygen gas and water are generated. The oxygen gas is collected through the flow path inside the first stack 16 and flows out from the first stack 16. The oxygen gas is stored in the first tank 12 through a first flow path 44. Thus, the pressure of the oxygen gas stored in the first tank 12 through the first flow path 44 is higher than the pressure of the hydrogen gas flowing into the gas-liquid separator 20 through the second flow path 46.

A back pressure valve 48 is disposed in the first flow path 44. The back pressure valve 48 maintains the pressure of the oxygen gas in the first flow path 44 at a predetermined pressure, for example, 1 to 100 MPa. The oxygen gas that has passed through the back pressure valve 48 is stored in the first tank 12. Therefore, each unit cell 30 is used in a state where a high differential pressure is generated between the anode 26*a* and the cathode 26*c* of the electrolyte membrane 26. Water generated in the anode 26*a* is returned to the cathode 26*c* through the electrolyte membrane 26 by the difference in pressure between the anode 26*a* and the cathode 26*c*, and flows into the second flow path 46.

A check valve 50 is provided in the first flow path 44. The check valve 50 is positioned between the back pressure valve 48 and the first stack 16. The check valve 50 allows the oxygen gas to pass only in a direction from the first stack 16 toward the first tank 12, and prevents the oxygen gas from flowing back from the first tank 12 to the first stack 16.

The electrochemical system 10 includes a first pressure sensor 52 connected to the first flow path 44 at the upstream side of the check valve 50 and a second pressure sensor 54 connected to the first flow path 44 at the downstream side of the check valve 50. The first pressure sensor 52 detects the pressure of oxygen gas at the upstream side of the check valve 50 in the first flow path 44. The second pressure sensor 54 detects the pressure of oxygen gas at the downstream side of the check valve 50 in the first flow path 44. The detection result of the first pressure sensor 52 and the detection result of the second pressure sensor 54 are input to the control unit 24.

The control unit 24 detects the presence or absence of damage to the electrolyte membrane 26 based on the detection result of the first pressure sensor 52 and the detection result of the second pressure sensor 54. Specifically, the control unit 24 determines that the electrolyte membrane 26 has been damaged when the differential pressure $\Delta P$ obtained by subtracting the pressure detected by the first pressure sensor 52 from the pressure detected by the second pressure sensor 54 exceeds a predetermined pressure.

The supply flow path 42 connects the first stack 16 to a water reservoir portion 20*w* of the gas-liquid separator 20. The water reservoir portion 20*w* is a portion of the gas-liquid separator 20 in which water is stored. Water stored in the water reservoir portion 20*w* of the gas-liquid separator 20 is supplied to the first stack 16 through the supply flow path 42. If necessary, a pump for sending water to the first stack 16 may be disposed in the supply flow path 42. The second flow path 46 connects the gas-liquid separator 20 and the first stack 16, and guides a fluid containing water and hydrogen gas discharged from the first stack 16, to the gas-liquid separator 20.

The gas-liquid separator 20 separates the fluid flowing into the second flow path 46 into hydrogen gas and liquid water. The gas-liquid separator 20 separates water from the hydrogen gas by gravity or centrifugal force. The water separated by the gas-liquid separator 20 is stored in the water reservoir portion 20*w*, and the hydrogen gas is collected in a gas recovery portion 20*g*.

The water stored in the water reservoir portion 20*w* is returned to the first stack 16 through the supply flow path 42. The water circulates between the gas-liquid separator 20 and the first stack 16 through the second flow path 46 and the supply flow path 42. The amount of water circulating between the gas-liquid separator 20 and the first stack 16 decreases as the electrochemical reaction in the first stack 16 progresses. To compensate for the decrease in water, the electrochemical system 10 includes the water tank 22. The water tank 22 supplies water to the water reservoir portion 20*w* of the gas-liquid separator 20 to keep the liquid level of the water reservoir portion 20*w* constant.

An exhaust device 56 is a device that discharges gas inside the second flow path 46 and the gas-liquid separator 20. The exhaust device 56 discharges gas inside the second flow path 46 and the gas-liquid separator 20 in accordance with the control of the control unit 24. When the pressure difference $\Delta P$ between the pressure detected by the first pressure sensor 52 and the pressure detected by the second pressure sensor 54 exceeds the predetermined pressure, that is, when damage to the electrolyte membrane 26 is detected, the control unit 24 controls the exhaust device 56 to discharge gas. In a case that the external environment is in a vacuum state, the exhaust device 56 can be configured by an exhaust path 58 and an exhaust valve 60 that opens and closes the exhaust path 58. When the electrochemical system 10 is disposed in the atmosphere or in water, the exhaust device 56 can be configured by combining a pump and a valve.

A second back pressure valve 62 is connected to the gas-liquid separator 20. The second back pressure valve 62 maintains the pressure of the second flow path 46 at a predetermined pressure lower than that of the first flow path 44.

The hydrogen gas from which water has been separated by the gas-liquid separator 20 is guided to the hydrogen pressure boosting stack 18 through a third flow path 64. The electrochemical system 10 includes a shutoff valve 66 and a catalyst device 68 in the third flow path 64. The shutoff valve 66 is positioned upstream of the catalyst device 68 in the third flow path 64. The shutoff valve 66 is a valve capable of closing the third flow path 64, and performs an opening and closing operation in accordance with control by the control unit 24. When damage to the electrolyte membrane 26 is detected, the control unit 24 controls the shutoff valve 66 to close the third flow path 64.

The catalyst device 68 includes a catalyst such as a noble metal (for example, platinum). The catalyst causes reaction between hydrogen gas and oxygen gas to convert a trace amount of oxygen gas mixed in hydrogen gas into water and remove the oxygen gas. The oxygen gas mixed in the third flow path 64 is derived from the first stack 16. That is, even when the electrolyte membrane 26 is not damaged, the first stack 16 allows a small amount of oxygen gas to permeate therethrough due to the difference in pressure between the anode 26*a* and the cathode 26*c*. The oxygen gas that has permeated through the electrolyte membrane 26 is accumulated in a circulation path 21 for hydrogen gas including the third flow path 64.

If a mixed gas with a high oxygen gas concentration is supplied to the catalyst device 68 due to damage to the electrolyte membrane 26, the mixed gas causes a severe reaction in the catalyst device 68, and the temperature of the catalyst device 68 rises greatly due to the heat of reaction. When the following two conditions, i.e., increase in the concentration of the oxygen gas in the hydrogen gas and high temperature of the catalyst device 68, are satisfied, the hydrogen gas and the oxygen gas forming the mixed gas may damage devices inside the electrochemical system 10. Therefore, in the electrochemical system 10 of the present embodiment, when damage to the electrolyte membrane 26 is detected, the supply of the mixed gas to the catalyst device 68 is stopped by the exhaust device 56 and the shutoff valve 66.

Although not particularly shown, the third flow path 64 may include a pump for sending hydrogen gas to the hydrogen pressure boosting stack 18.

The hydrogen pressure boosting stack 18 is connected to a downstream end portion of the third flow path 64. The hydrogen pressure boosting stack 18 has a structure in which a plurality of unit cells 32 are stacked. Each unit cell 32 has an electrolyte membrane 28, and a cathode 28*c* and an anode 28*a* sandwiching the electrolyte membrane 28. The hydrogen pressure boosting stack 18 of the present embodiment is a hydrogen ion conductive membrane that transports protons $H^+$ as the electrolyte membrane 28. The electrolyte membrane 28 converts hydrogen gas supplied to the anode 28*a* into protons $H^+$. The electrolyte membrane 28 moves the protons $H^+$ toward the cathode 28*c* due to a potential difference between the anode 28*a* and the cathode 28*c*. The movement of the protons $H^+$ proceeds against the pressure difference between both sides of the electrolyte membrane 28. The protons $H^+$ receive electrons at the cathode 28*c* and are released as hydrogen gas. The electrolyte membrane 28 generates the pressure-boosted hydrogen gas in the cathode 28*c*.

The cathode 28*c* of the electrolyte membrane 28 communicates with a fourth flow path 70. The fourth flow path 70 connects the hydrogen pressure boosting stack 18 and the second tank 14. The hydrogen gas pressure-boosted by the electrolyte membrane 28 is stored in the second tank 14 through the fourth flow path 70.

On the other hand, the hydrogen gas discharged from the gas-liquid separator 20 is supplied to the anode 28*a* of the electrolyte membrane 28 through the third flow path 64. The hydrogen gas is used in the electrochemical reaction in the anode 28*a*. The hydrogen gas that has not been used for the electrochemical reaction is returned to the gas-liquid separator 20 through a fifth flow path 72. The fifth flow path 72 forms the circulation path 21 for circulating hydrogen gas between the gas-liquid separator 20 and the anode 28*a* of the hydrogen pressure boosting stack 18, together with the third flow path 64.

The electrochemical system 10 of the present embodiment is configured as described above. The operation of the electrochemical system 10 will be described below.

Figure 2:
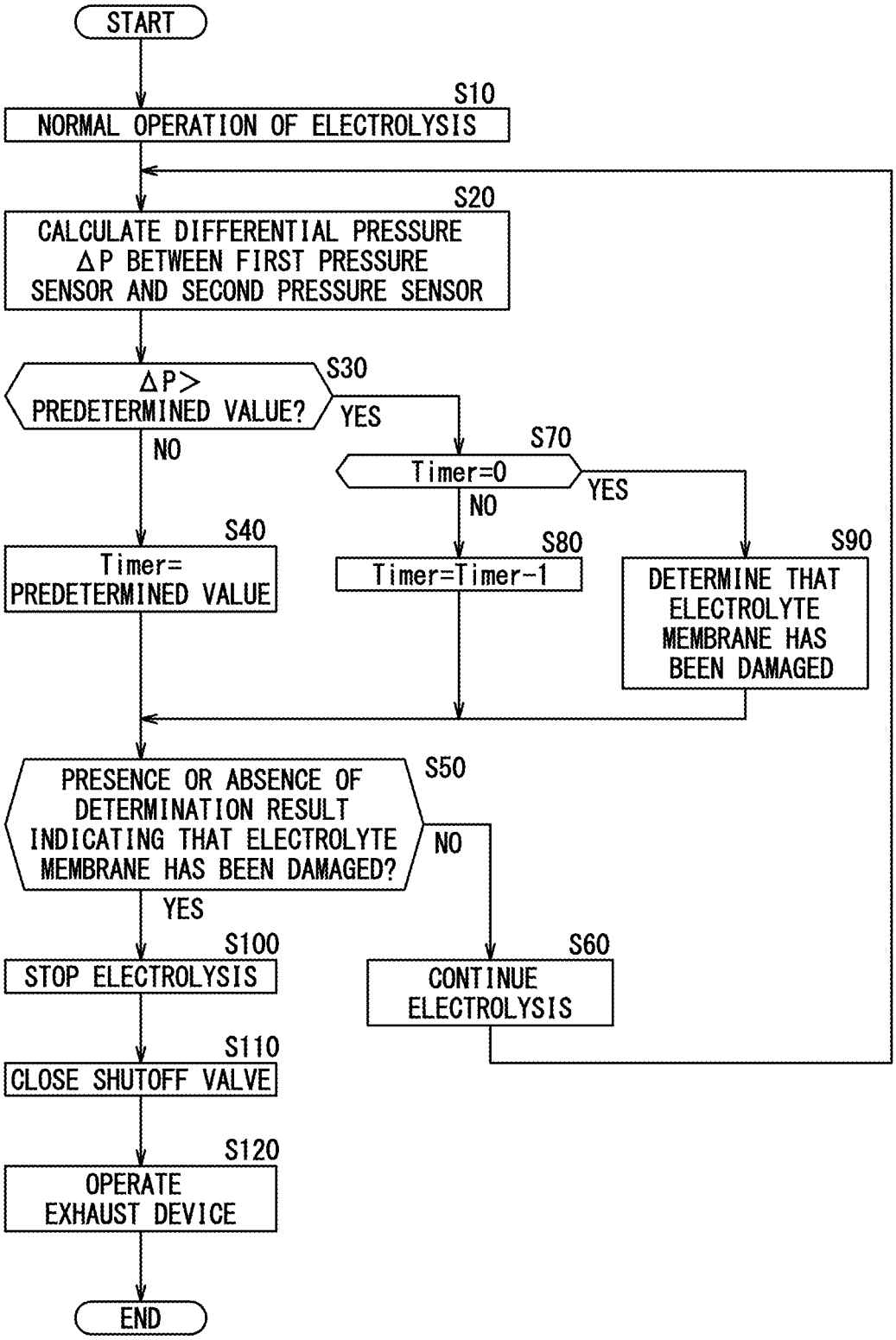
FIG. 2 is a flow chart showing operations of the electrochemical system of FIG. 1.

As shown in FIG. 2, when the electrochemical system 10 starts electrolysis, the process proceeds to step S10 after a predetermined start-up step. The control unit 24 supplies predetermined electric power to the first stack 16 and the hydrogen pressure boosting stack 18. Thus, the first stack 16 performs water electrolysis, and a high-pressure oxygen gas is stored in the first tank 12. In addition, the hydrogen pressure boosting stack 18 performs pressure boosting, and a high-pressure hydrogen gas is stored in the second tank 14.

Next, in step S20, the control unit 24 obtains the differential pressure ΔP (absolute value) by subtracting the pressure detected by the first pressure sensor 52 from the pressure detected by the second pressure sensor 54.

Next, in step S30, the control unit 24 determines whether or not the differential pressure ΔP is larger than a predetermined value. In normal operation, the first flow path 44 shown in FIG. 1 allows oxygen gas to flow in the forward direction of the check valve 50. In the forward flow, the pressure difference between the upstream and the downstream of the check valve 50 is small, and thus the pressure difference ΔP is equal to or less than the predetermined pressure. Therefore, when the differential pressure ΔP is equal to or lower than the predetermined pressure, the control unit 24 determines that the electrolyte membrane 26 is not damaged (NO).

When the control unit 24 determines NO in step S30, the process proceeds to step S40. In step S40, the control unit 24 sets the timer for a predetermined value. The predetermined value for which the timer is set in step S40 reflects the waiting time for determining the presence or absence of damage to the electrolyte membrane 26.

Thereafter, the process proceeds to step S50. In step S50, the control unit 24 detects the presence or absence of a determination (flag) indicating that the electrolyte membrane 26 has been damaged. The determination of the presence or absence of damage to the electrolyte membrane 26 is performed in step S90 described later. In the normal operation in which the differential pressure ΔP is less than the predetermined pressure, the control unit 24 determines that the electrolyte membrane 26 is not damaged (NO), in step S50.

On the other hand, in the first stack 16 shown in FIG. 1, when the electrolyte membrane 26 is damaged, leakage of the oxygen gas from the high-pressure anode 26*a* to the low-pressure cathode 26*c* occurs. Therefore, the oxygen gas tries to flow through the first flow path 44 in the opposite direction, but the check valve 50 blocks the flow of the oxygen gas through the first flow path 44. As a result, a large differential pressure ΔP occurs between the upstream and the downstream of the check valve 50. When the value of the differential pressure ΔP exceeds the predetermined pressure in step S30, the control unit 24 determines YES in step S30.

When the control unit 24 determines YES in step S30, the process proceeds to step S70 to determine whether the detection result indicating that the differential pressure ΔP exceeds the predetermined pressure has continued for a predetermined waiting time or not. In step S70, the control unit 24 determines whether or not the value of the timer is 0. When the value of the timer is not 0 in step S70 (NO), the control unit 24 determines that the predetermined waiting time has not elapsed, and the process proceeds to step S80. In step S80, the control unit 24 subtracts 1 from the value of the timer, and the process proceeds to step S50. The value of the timer is decreased by 1 from the predetermined value set in step S40 every time step S80 is performed. The processing of step S70 and step S80 is repeated until the value of the timer becomes 0. During this time, the electrochemical system 10 continues the electrolysis process.

On the other hand, in step S70, when the value of the timer is 0, the control unit 24 determines that the detection result indicating that the detected pressure exceeds the predetermined pressure has continued for the predetermined waiting time (YES), and the process proceeds to step S90. In step S90, the control unit 24 determines that the electrolyte membrane 26 has been damaged. Thereafter, the process proceeds to step S50.

Note that steps S70 to S80 are an example for preventing erroneous detection due to noise of the first pressure sensor 52 and the second pressure sensor 54, and the present embodiment is not limited to this example. When another method for preventing the noise of the first and second pressure sensors 52 and 54 is adopted, steps S70 to S80 may be omitted.

When the control unit 24 determines that the electrolyte membrane 26 has been damaged in step S90, the control unit 24 determines (YES) in step S50, and advances the process to step S100.

In step S100, the control unit 24 stops the supply of electric power to the first stack 16 and the hydrogen pressure boosting stack 18. In step S110, the control unit 24 closes the shutoff valve 66 of FIG. 1 to shut off the third flow path 64. By blocking the third flow path 64, the supply of the mixed gas containing a large amount of oxygen gas to the catalyst device 68 is prevented. As a result, the electrochemical system 10 can prevent overheating of the catalyst device 68 and ignition of the mixed gas of hydrogen gas and oxygen gas. The shutoff valve 66 prevents the oxygen gas from flowing into the hydrogen pressure boosting stack 18, thereby preventing deterioration of the catalyst (for example, platinum) used in the electrodes of the hydrogen pressure boosting stack 18.

Thereafter, in step S120, the control unit 24 operates the exhaust device 56 to exhaust the mixed gas in the second flow path 46 and the gas-liquid separator 20. The exhaust device 56 prevents damage to the devices by reducing the concentration of the mixed gas in the second flow path 46 and the gas-liquid separator 20 to below the explosive range.

The processing of steps S100 to S120 is not limited to the order shown in the drawings, and may be performed in any order, or all the steps may be performed simultaneously.

On the other hand, in step S50, when the control unit 24 determines that there is no determination of damage to the electrolyte membrane 26 (NO), the control unit 24 advances the process to step S60. In step S60, the electrolysis process is continued. That is, the supply of electric power to the first stack 16 and the hydrogen pressure boosting stack 18 is continued. Thereafter, the process returns to step S20.

Second Embodiment

Figure 3:
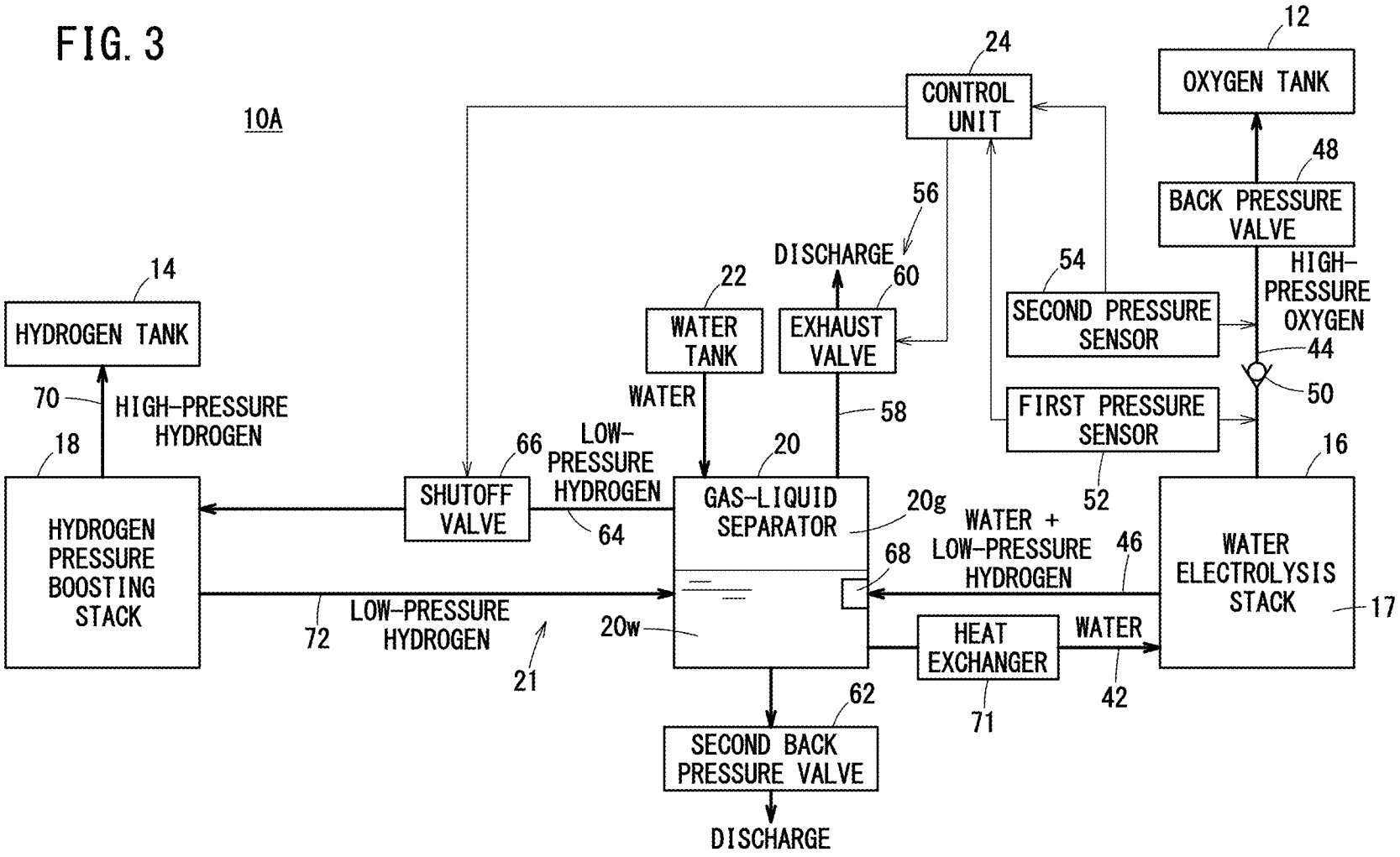
FIG. 3 is a diagram showing a configuration of an electrochemical system according to a second embodiment.

The electrochemical system 10A of the present embodiment shown in FIG. 3 is an example in which the arrangement of the catalyst device 68 of the electrochemical system 10 of FIG. 1 is changed. In the description of the electrochemical system 10A (FIG. 3), the same components as those of the electrochemical system 10 (FIG. 1) are denoted by the same symbols, and the detailed description thereof will be omitted.

In the electrochemical system 10A, a catalyst device 68 is connected to the downstream of the second flow path 46. The catalyst device 68 of the present embodiment is disposed so as to protrude into the gas-liquid separator 20. The catalyst device 68 is disposed at a position in contact with water in the water reservoir portion 20*w*.

The electrochemical system 10A also includes a heat exchanger 71 in the supply flow path 42. The heat exchanger 71 dissipates heat that is generated in the catalyst device 68 to the outside, by lowering the temperature of water.

The catalyst device 68 can quickly release the heat that is generated when the catalyst device 68 contacts the mixed gas of oxygen gas and hydrogen gas, to the water in the water reservoir portion 20*w*. Therefore, the electrochemical system 10A of the present embodiment can suppress the temperature rise of the catalyst device 68, and can prevent the ignition of the mixed gas of hydrogen gas and oxygen gas by the catalyst device 68.

The heat exchanger 71 can prevent evaporation of the water stored in the water reservoir portion 20*w* of the gas-liquid separator 20 by lowering the temperature of the water circulating between the gas-liquid separator 20 and the first stack 16.

Third Embodiment

Figure 4:
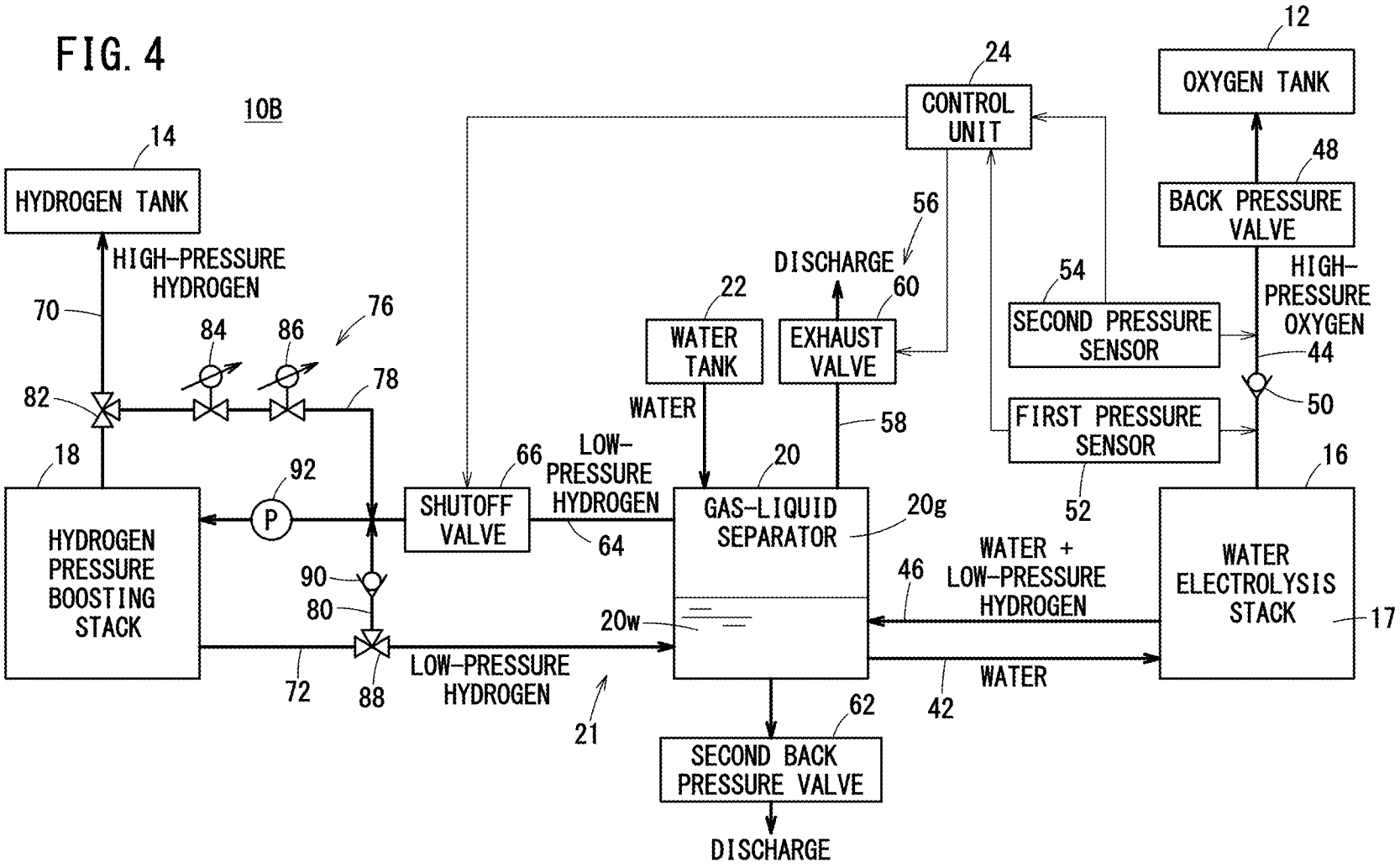
FIG. 4 is a diagram showing a configuration of an electrochemical system according to a third embodiment.

The electrochemical system 10B shown in FIG. 4 is a modification of the electrochemical system 10 shown in FIG. 1, in which a pressure reduction adjustment unit 76 capable of supplying hydrogen gas to the third flow path 64 is added. In the description of the electrochemical system 10B (FIG. 4), the same components as those described in the electrochemical system 10 (FIG. 1) are denoted by the same symbols, and the detailed description thereof will be omitted.

As shown in FIG. 4, the electrochemical system 10B has the pressure reduction adjustment unit 76. The pressure reduction adjustment unit 76 has a sixth flow path 78 and a seventh flow path 80. The sixth flow path 78 is a flow path that connects the fourth flow path 70 and the third flow path 64. One end of the sixth flow path 78 is connected to the fourth flow path 70 via a three way valve 82, and the other end of the sixth flow path 78 is connected to the third flow path 64 at the downstream of the shutoff valve 66. The sixth flow path 78 has a second shutoff valve 84 and a pressure reducing valve 86 therein. The second shutoff valve 84 is opened and closed by the control of the control unit 24. In the normal operation of the electrochemical system 10B, the second shutoff valve 84 shuts off the flow of the hydrogen gas in the sixth flow path 78. The second shutoff valve 84 opens the sixth flow path 78 when the control unit 24 detects damage to the electrolyte membrane 26. The pressure reducing valve 86 reduces the pressure of a high-pressure hydrogen gas flowing through the sixth flow path 78 and supplies the hydrogen gas to the third flow path 64.

The seventh flow path 80 is a flow path that connects the fifth flow path 72 and the third flow path 64. One end of the seventh flow path 80 is connected to the fifth flow path 72 via a three way valve 88, and the other end of the seventh flow path 80 is connected to the third flow path 64 at the downstream of the shutoff valve 66. The seventh flow path 80 has a second check valve 90 therein. The second check valve 90 allows gas to flow only in the direction from the fifth flow path 72 toward the third flow path 64.

In the third flow path 64 of FIG. 4, illustration of the catalyst device 68 (see FIG. 1) is omitted. The third flow path 64 is provided with a pump 92 for sending hydrogen gas toward the hydrogen pressure boosting stack 18.

The electrochemical system 10B of the present embodiment is configured as described above. The operation of the electrochemical system 10B will be described below.

When the electrochemical system 10B detects damage to the electrolyte membrane 26 of the first stack 16, the shutoff valve 66 of the third flow path 64 is closed, and the mixed gas containing hydrogen gas and oxygen gas is discharged from the gas-liquid separator 20 through the exhaust device 56. As a result, the pressure at the anode 28*a* of the hydrogen pressure boosting stack 18 (see FIG. 1) rapidly decreases. The rapid decrease in pressure at the anode 28*a* of the hydrogen pressure boosting stack 18 causes bumping of water inside the electrolyte membrane 28, and consequently damage due to pores occurs inside the electrolyte membrane 28. Therefore, the hydrogen pressure boosting stack 18 is required to be gradually reduced in pressure.

In the electrochemical system 10B of the present embodiment, when the shutoff valve 66 of the third flow path 64 is closed and the exhaust device 56 starts exhausting, the control unit 24 controls the pressure reduction adjustment unit 76 to start the operation for supplying the third flow path 64 with hydrogen gas through the sixth flow path 78 and the seventh flow path 80 in order to prevent the rapid pressure reduction at the anode 28*a* of the hydrogen pressure boosting stack 18.

When the shutoff valve 66 of the third flow path 64 is closed, the control unit 24 turns the three way valve 82 of the sixth flow path 78 to establish communication between the fourth flow path 70 and the sixth flow path 78 and open the second shutoff valve 84. As a result, the hydrogen gas in the fourth flow path 70 is supplied to the third flow path 64 through the sixth flow path 78.

The control unit 24 turns the three way valve 88 of the seventh flow path 80 to establish communication between the fifth flow path 72 and the seventh flow path 80. As a result, the hydrogen gas in the fifth flow path 72 is supplied to the third flow path 64 through the seventh flow path 80.

In this way, the electrochemical system 10B of the present embodiment can prevent a rapid decrease in pressure at the anode 28*a* of the hydrogen pressure boosting stack 18 because the hydrogen gas is supplied to the third flow path 64 through the sixth flow path 78 and the seventh flow path 80 after the shutoff valve 66 of the third flow path 64 has been closed.

Fourth Embodiment

Figure 5:
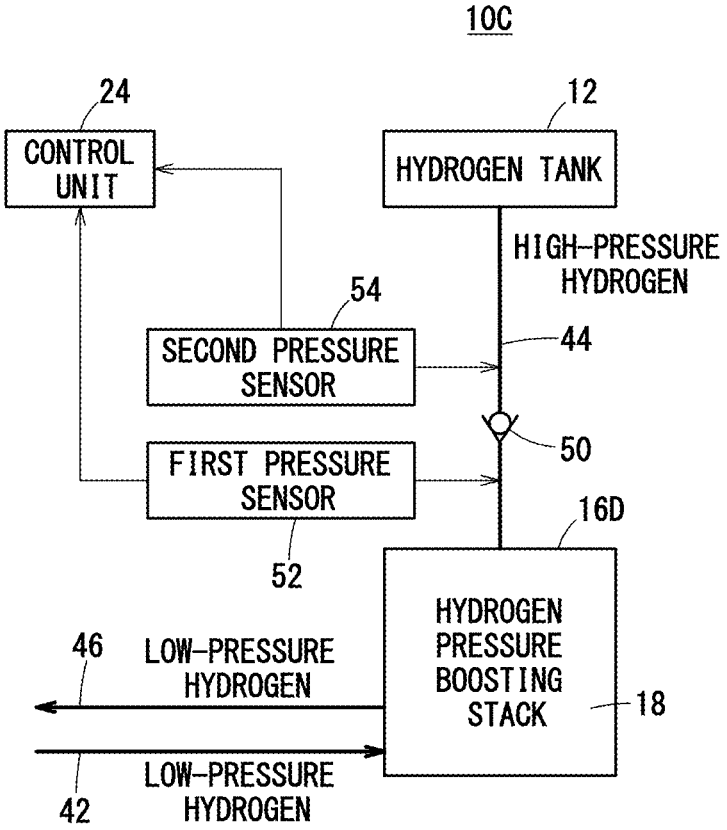
FIG. 5 is a diagram showing a configuration of an electrochemical system according to a fourth embodiment.

The electrochemical system 10C of the present embodiment shown in FIG. 5 has a hydrogen pressure boosting stack 18 as a first stack 16D. The hydrogen pressure boosting stack 18 includes an electrolyte membrane 28, and electrochemically boosts the pressure of hydrogen gas that has flowed into the hydrogen pressure boosting stack. The hydrogen pressure boosting stack 18 is connected to the first tank (hydrogen tank) 12 through a first flow path 44. The first flow path 44 includes a check valve 50, a first pressure sensor 52 connected to the upstream side of the check valve 50, and a second pressure sensor 54 connected to the downstream side of the check valve 50.

Unreacted hydrogen gas is discharged as a second gas from the first stack 16D through the second flow path 46. That is, in the present embodiment, both the first gas and the second gas are hydrogen gas.

The control unit 24 determines whether the electrolyte membrane 28 of the first stack 16D has been damaged based on the differential pressure ΔP between the first pressure sensor 52 and the second pressure sensor 54. When the control unit 24 determines that the electrolyte membrane 28 has been damaged, the control unit 24 operates a shutoff valve or an exhaust device (not shown) connected to the second flow path 46, thereby preventing an accident due to leakage of hydrogen gas.

The above disclosure is summarized as follows.

The electrochemical system 10, 10A, 10B, 10C of an aspect of the present invention includes: the first stack 16, 16D including the membrane electrode assembly 27 containing: the electrolyte membrane 26; and the first electrode 26*a* and the second electrode 26*c* sandwiching the membrane electrode assembly therebetween; the first tank 12 configured to store the first gas having a high-pressure, output from the first stack; the check valve 50 disposed in the flow path 44 that connects the first stack and the first tank; the first pressure sensor 52 connected to the flow path at the upstream of the check valve; the second pressure sensor 54 connected to the flow path at the downstream of the check valve; and the control unit (the processing circuitry) 24 configured to determine whether the electrolyte membrane has been damaged or not, based on the pressure detected by the first pressure sensor and the pressure detected by the second pressure sensor, wherein the control unit detects that the electrolyte membrane has been damaged when the differential pressure ΔP obtained by subtracting the pressure detected by the first pressure sensor from the pressure detected by the second pressure sensor exceeds the predetermined pressure.

The above-described electrochemical system can prevent a trouble due to leakage of the first gas from occurring, by determining whether the electrolyte membrane has been damaged based on the differential pressure between the upstream and the downstream of the check valve of the first flow path.

The above-described electrochemical system may further include the exhaust device 56 configured to discharge the second gas discharged from the first stack, to outside, wherein, when it is determined that the electrolyte membrane has been damaged, the control unit may control the exhaust device to discharge the second gas. In this electrochemical system, the leaked first gas is exhausted together with the second gas, and thus it is possible to prevent a trouble due to a mixed gas of the first gas and the second gas from occurring.

In the above-described electrochemical system, the first stack may be the water electrolysis stack 17 configured to generate oxygen gas as the first gas and hydrogen gas as the second gas by electrolyzing supplied water, and the electrochemical system may further include the gas-liquid separator 20 configured to separate water supplied to the first stack and hydrogen gas discharged from the first stack. This electrochemical system can prevent troubles caused by a mixed gas of hydrogen and oxygen from occurring.

In the above-described electrochemical system, the gas-liquid separator may be provided with the exhaust device. This electrochemical system can discharge only gas, and thus can suppress the loss of water.

The above-described electrochemical system may further include the hydrogen pressure boosting stack 18 configured to boost the pressure of hydrogen gas separated from water by the gas-liquid separator; and the shutoff valve 66 configured to shut off supply of hydrogen gas from the gas-liquid separator to the hydrogen pressure boosting stack, wherein, when it is determined that the electrolyte membrane has been damaged, the control unit may control the shutoff valve to shut off the supply of the hydrogen gas from the gas-liquid separator to the hydrogen pressure boosting stack. This electrochemical system can prevent the mixed gas of hydrogen and oxygen from flowing into the hydrogen pressure boosting stack, and can prevent the catalyst of the hydrogen pressure boosting stack from deteriorating.

In the above-described electrochemical system, the shutoff valve may be provided in the third flow path 64 connected to the gas-liquid separator and to the hydrogen pressure boosting stack.

The above-described electrochemical system may further include the catalyst device 68 configured to remove oxygen gas from hydrogen gas supplied from the first stack to the hydrogen pressure boosting stack, by the catalytic reaction. This electrochemical system can prevent the mixed gas of hydrogen gas and oxygen gas from being ignited by the catalyst device.

In the above-described electrochemical system, the shutoff valve may be provided in the third flow path connected to the gas-liquid separator and the hydrogen pressure boosting stack, and the catalyst device may be disposed downstream of the shutoff valve in the third flow path. In this electrochemical system, the shutoff valve can prevent the mixed gas of hydrogen and oxygen from flowing into the catalyst device.

In the above-described electrochemical system, the catalyst device may be disposed at a portion of the gas-liquid separator that is in contact with water stored in the gas-liquid separator. This electrochemical system can prevent ignition of the mixed gas of hydrogen gas and oxygen gas by releasing heat generated in the catalyst device to water.

The above-described electrochemical system may further include the pressure reduction adjustment unit 76 configured to return hydrogen gas that is output from the hydrogen pressure boosting stack and is pressure-boosted, to the hydrogen pressure boosting stack, and wherein, when it is determined that the electrolyte membrane has been damaged, the control unit may control the pressure reduction adjustment unit to return the hydrogen gas to the hydrogen pressure boosting stack. This electrochemical system can prevent damage to the electrolyte membrane by preventing rapid decrease in pressure of the hydrogen pressure boosting stack due to operation of the exhaust device or blockage of the shutoff valve from occurring.

Moreover, the present invention is not limited to the above-described disclosure, and various configurations can be adopted therein without departing from the essence and gist of the present invention.

The invention claimed is:

1. An electrochemical system comprising:

a first stack including a membrane electrode assembly containing: an electrolyte membrane; and a first electrode and a second electrode sandwiching the membrane electrode assembly therebetween;

a first tank configured to store a first gas having a high-pressure, output from the first stack;

a check valve disposed in a flow path that connects the first stack and the first tank;

a first pressure sensor connected to the flow path at an upstream of the check valve;

a second pressure sensor connected to the flow path at a downstream of the check valve; and a processing circuitry, wherein the processing circuitry determines whether the electrolyte membrane has been damaged or not, based on a pressure detected by the first pressure sensor and a pressure detected by the second pressure sensor, wherein the processing circuitry obtains a differential pressure by subtracting the pressure detected by the first pressure sensor from the pressure detected by the second pressure sensor, and the processing circuitry determines that the electrolyte membrane has been damaged when the differential pressure exceeds a predetermined pressure.

2. The electrochemical system according to claim 1, further comprising:

an exhaust device configured to discharge a second gas discharged from the first stack to outside of the electrochemical system, wherein, when it is determined that the electrolyte membrane has been damaged, the processing circuitry controls the exhaust device to discharge the second gas.

3. The electrochemical system according to claim 2, wherein the first stack is a water electrolysis stack configured to generate oxygen gas as the first gas and hydrogen gas as the second gas by electrolyzing supplied water, and the electrochemical system further comprises a gas-liquid separator configured to separate water supplied to the first stack and the hydrogen gas discharged from the first stack.

4. The electrochemical system according to claim 3, wherein the gas-liquid separator is provided with the exhaust device.

5. The electrochemical system according to claim 3, further comprising:

a hydrogen pressure boosting stack configured to boost a pressure of the hydrogen gas separated from the water by the gas-liquid separator; and a shutoff valve configured to shut off supply of the hydrogen gas from the gas-liquid separator to the hydrogen pressure boosting stack, wherein, when it is determined that the electrolyte membrane has been damaged, the processing circuitry controls the shutoff valve to shut off the supply of the hydrogen gas from the gas-liquid separator to the hydrogen pressure boosting stack.

6. The electrochemical system according to claim 5, wherein the shutoff valve is provided in a third flow path connected to the gas-liquid separator and to the hydrogen pressure boosting stack.

7. The electrochemical system according to claim 5, further comprising a catalyst device configured to remove oxygen gas from the hydrogen gas supplied from the first stack to the hydrogen pressure boosting stack by a catalytic reaction.

8. The electrochemical system according to claim 7, wherein the shutoff valve is provided in a third flow path connected to the gas-liquid separator and the hydrogen pressure boosting stack, and the catalyst device is disposed downstream of the shutoff valve in the third flow path.

9. The electrochemical system according to claim 7, wherein the catalyst device is disposed at a portion of the gas-liquid separator that is in contact with water stored in the gas-liquid separator.

10. The electrochemical system according to claim 5, further comprising a pressure reduction adjustment unit configured to return the hydrogen gas that is output from the hydrogen pressure boosting stack and is pressure-boosted to the hydrogen pressure boosting stack, wherein, when it is determined that the electrolyte membrane has been damaged, the processing circuitry controls the pressure reduction adjustment unit to return the hydrogen gas to the hydrogen pressure boosting stack.

* * * * *